US006273201B1

(12) United States Patent
Randa et al.

(10) Patent No.: US 6,273,201 B1
(45) Date of Patent: Aug. 14, 2001

(54) PNEUMATIC GROUND PIERCING TOOL WITH MOVABLE CHISEL HEAD

(75) Inventors: Mark D. Randa, Summit; Steven W. Wentworth, Brookfield; Robert F. Crane, Ocon, all of WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 09/505,640

(22) Filed: Feb. 16, 2000

(51) Int. Cl.[7] ..... E21B 1/00; E21B 4/14

(52) U.S. Cl. ..... 175/19

(58) Field of Search ..... 175/19, 21, 22, 175/40, 45, 230, 61, 325, 62, 305, 306; 173/20, 91, 132, 133

(56) References Cited

U.S. PATENT DOCUMENTS

| | | | |
|---|---|---|---|
| 3,941,101 | 3/1976 | Kostylev et al. | 123/46 |
| 3,970,157 | 7/1976 | Schmidt | 175/22 |
| 4,100,980 | 7/1978 | Jenne | 175/19 |
| 4,221,157 | 9/1980 | Schmidt | 91/416 |
| 4,462,468 | 7/1984 | Jenne | 173/121 |
| 4,732,222 | 3/1988 | Schmidt | 175/22 |
| 4,938,297 | 7/1990 | Schmidt | 175/19 |
| 5,010,965 | 4/1991 | Schmelzer | 175/19 |
| 5,226,487 | 7/1993 | Spektor | 175/19 |

*Primary Examiner*—Robert E. Pezzuto
(74) *Attorney, Agent, or Firm*—Philip G. Meyers; Philip G. Meyers Intellectual Property Law, P.C.

(57) ABSTRACT

A ground piercing tool has an elongated tubular tool housing and a striker that reciprocates within an internal chamber of the housing. The striker impacts a front impact surface and drives the tool through the ground. An air distributing mechanism causes the striker to reciprocate in response to a supply of compressed fluid. An anvil providing a front impact surface is disposed in a front end opening of the tool housing. The anvil has a rear frustoconical portion that engages a like-shaped forwardly tapering inner wall of the housing and a lengthwise bore that has an enlarged diameter portion. A chisel is slidably disposed in the bore of the anvil and has an outwardly opening annular groove. A spring is confined in compression in a space defined by the annular groove of the chisel and the enlarged diameter portion of the anvil bore. The spring urges the rear end of the chisel to protrude rearwardly from the bore of the anvil a predetermined distance. The spring compresses as the striker delivers an impact to the chisel and moves the chisel forward until the striker contacts a rear end of the anvil.

27 Claims, 4 Drawing Sheets

PNEUMATIC GROUND PIERCING TOOL WITH MOVABLE CHISEL HEAD

TECHNICAL FIELD OF THE INVENTION

The invention relates, in general, to pneumatic impact tools and, in particular to a movable chisel head for a pneumatic impact tool.

BACKGROUND OF THE INVENTION

Self-propelled pneumatic tools for making small diameter holes through soil are well known. Such tools are used to form holes for pipes or cables beneath roadways without need for digging a trench across the roadway. These tools include, as general components, a torpedo-shaped body having a tapered nose and an open rear end, an air supply hose that enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental movement through the soil.

Some pneumatic tools incorporate movable bits or chisels at the tapered nose section of the tool to more easily penetrate hard ground. Although this concentration of force is useful for penetrating obstructions, total tool displacement per impact is reduced. This inefficiency causes slower tool speeds when the tool is not penetrating hard ground conditions. To the extent the movable chisel and bit mounted on it move outwardly from the tool body during impact, there is also a tendency for soil to enter the gap behind the bit between the bit and tool body and cause the chisel to become jammed. Spektor U.S. Pat. No. 5,031,706 describes using a resilient gasket confined under compression between the movable head and chisel adapter as a means of preventing soil from entering behind the chisel.

Some prior movable chisel tools have also relied on elaborate front end structures which are susceptible to breakage and more difficult to assemble and disassemble than tools wherein the anvil of the tool does not move. Another has the disadvantage of delivering direct impacts to the rear end of an anvil that is threadedly secured in a front end opening of the tool body, damaging the threaded connection and/or making it difficult to disengage the anvil when the chisel requires replacement. See, for example, U.S. Pat. No. 4,462,468.

In normal operation, the chisel is spring-biased to a position at which its rear end protrudes beyond the read end or impact surface of the anvil. If the chisel encounters an obstruction and is not moved all the way forward as a result of receiving an impact from the striker, then all of the striker's energy continues to be transferred to the chisel with each repeated forward stroke until the rear end of the chisel is flush with the impact surface of the anvil. The present invention provides a movable chisel of simple but durable design that allows the tool to penetrate hard ground and maintain tool performance better than other movable chisels currently in commercial use.

SUMMARY OF THE INVENTION

According to a first aspect of the invention, a ground piercing tool includes an elongated tubular tool housing, a striker disposed for reciprocation within an internal chamber of the housing to impart impacts to a front impact surface for driving the tool forwardly through the ground, and an air distributing mechanism that reciprocates the striker in response to a supply of compressed fluid. An anvil disposed in a front end opening of the tool housing, which anvil includes a rear, outer frustoconical portion which engages a like-shaped forwardly tapering inner wall of the housing whereby the anvil is held in the housing. The anvil has a lengthwise bore therein, and a rear end of the anvil defines the front impact surface for the striker. A chisel is slidably disposed in the bore of the anvil, which chisel is movable between a rearwardmost position at which a rear end portion of the chisel protrudes from the bore of the anvil to receive an initial impact from the striker, and a forwardmost position at which the striker can impact directly on the rear impact surface of the anvil. A spring may be confined in a space between the chisel and anvil to cause the rear end of the chisel to protrude rearwardly from the bore of the anvil a predetermined distance. The spring compresses as the striker delivers an impact to the chisel and moves the chisel forward until the striker contacts the rear end of the anvil.

Virtually all prior movable chisel ground piercing tools have used a spring. According to a further aspect of the invention, it has been found that the spring can be omitted and the chisel can be configured to return to a position at which a rear end of the chisel protrudes a short distance from the opening in the anvil. If the bit is held in place by the soil, the striker will impact the front anvil and can therefore drive the housing forward until it stops against the bit, thus resetting the chisel. If the bit is not secured by the soil, the striker impacts the chisel, and drives it forward through the already opened bore. Since the bore was already opened, very little energy is used in moving the bit and chisel. The striker will continue moving forward until it impacts the front anvil, driving the housing forward to catch up with the bit and chisel. In either case, the chisel is reset.

A ground piercing tool according to this aspect of the invention having a housing, striker and air distributing mechanism as described above includes an anvil disposed in a front end opening of the tool housing. The anvil has a lengthwise bore therein, and a rear end of the anvil defines the front impact surface for the striker. The chisel is slidably disposed in the bore of the anvil and is movable between a rearwardmost position at which a rear end portion of the chisel protrudes from the bore of the anvil to receive an initial impact from the striker, and a forwardmost position at which the striker can impact directly on a rear impact surface of the anvil. The chisel has an enlarged diameter rear end portion or stop that is in close sliding contact with an enlarged rear end portion of the anvil bore such that the enlarged diameter rear end portion of the chisel engages a step at the front end of the enlarged rear end portion of the anvil bore when the chisel is in its forwardmost position. Most preferably, the step and a contact surface of the enlarged diameter rear end portion of the chisel have a forwardly tapering, frustoconical shape with a sufficient taper to cause the chisel to become temporarily locked in its forwardmost position during rearward tool operation.

A bit is mounted on a front end portion of the chisel. The bit has an outer surface configured to engage the wall of a hole being bored so that as the striker first impacts the chisel and propels the chisel and bit forward, then impacts the impact surface of the anvil, and then moves rearwardly in preparation for another impact, the chisel and bit are propelled forward, increasing a gap between the bit and the front end of the housing. Thereafter, the housing is propelled forward, decreasing the gap between the bit and the front end of the housing and causing the chisel to assume its rearwardmost position without the aid of a spring. Removal of the spring improves the efficiency of operation because some of the striker's energy is lost in the process of compressing the spring on each impact.

The invention further provides a ground piercing tool provided with a wear cover configured to fit over the nose of the ground piercing tool housing, which nose includes a reduced diameter cylindrical front end portion and a forwardly tapering portion rearwardly thereof. The wear cover comprises a cylindrical sleeve having a forwardly tapering inner surface that engages the forwardly tapering portion of the nose of the housing. It can be friction fit over the nose and replaced when necessary. The invention also provides a two-piece threaded bit system wherein the two bit sections are tightened against one another for enhanced security and the front end of the bit shaft is covered. A V-shaped notch with optional seal as described hereafter may be provided for preventing dirt from entering in behind the bit and jamming the movement of the bit and chisel. These and other aspects of the invention are described in detail below.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

While various embodiments of the invention are discussed in detail below, it should be appreciated that the present invention provides many applicable inventive concepts which can be embodied in a wide variety of contexts. The embodiments discussed herein are merely illustrative of specific ways to make and use the invention and are not to limit the scope of the invention.

DETAILED DESCRIPTION OF THE INVENTION

Figure 1:
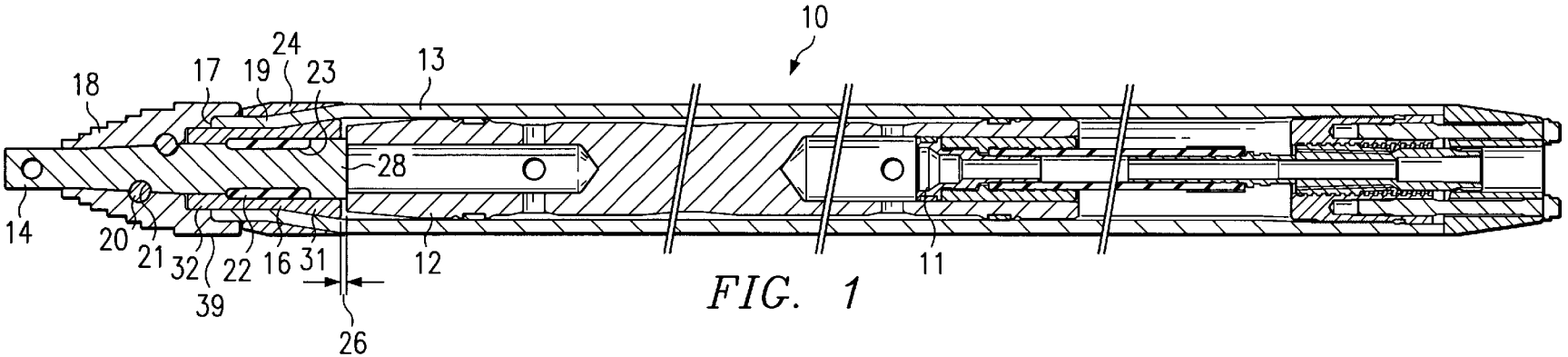
FIG. 1 is a lengthwise sectional view of a pneumatic ground piercing tool having a movable chisel head according to the invention.
Figure 2:
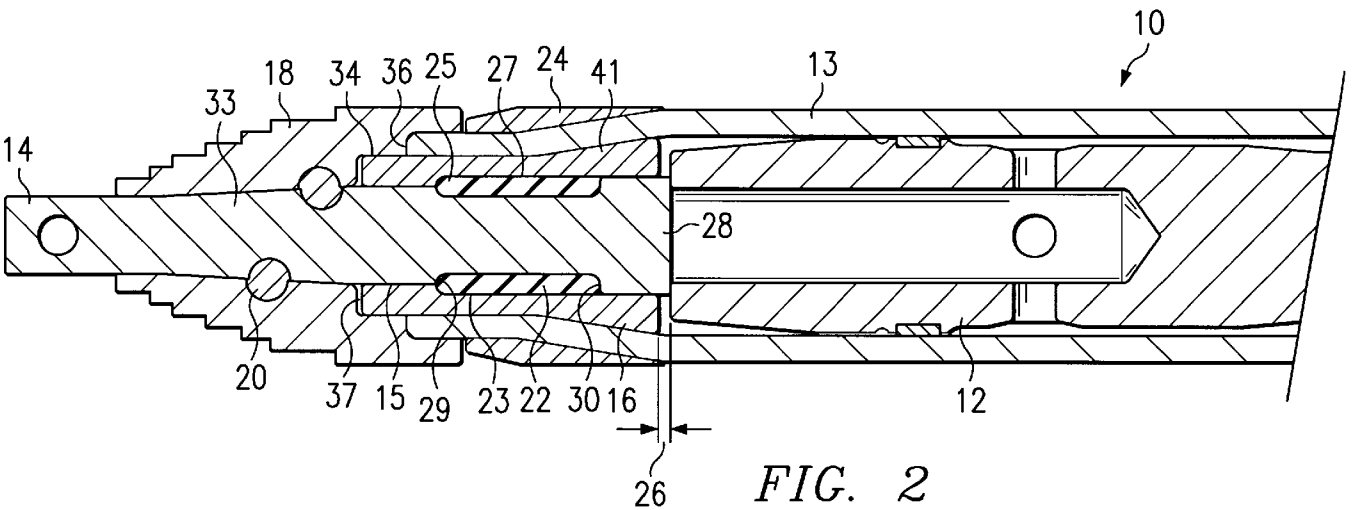
FIG. 2 is a forward section of the tool of FIG. 1, showing the orientation of the striker at the instant it impacts the chisel.
Figure 3:
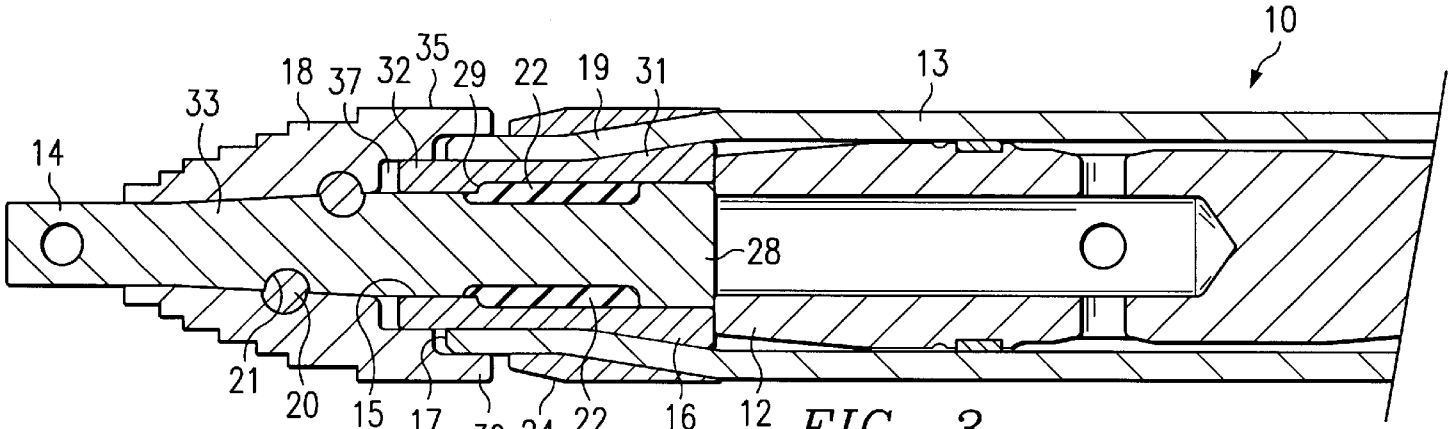
FIG. 3 is a forward section of the tool of FIG. 1 showing the orientation of the striker and chisel after impact.

Referring now to FIGS. 1–3, a pneumatic ground piercing tool 10 having a movable chisel assembly according to the invention includes an air distributing mechanism 11 for reciprocating a striker 12 disposed within a housing 13. Air distributing mechanism 11 includes a screw-reverse reversing mechanism actuated by rotating the air supply hose in a manner known in the art. Preferred air distributing mechanisms for use in the present invention are exemplified in U.S. Pat. Nos. 5,603,383, 5,505,270, 5,487,430, 5,465,797, 5,199,151 and 5,025,868, the entire contents of which are hereby incorporated by reference herein. Compressed air is supplied through a hose to air distributing mechanism 11, which causes striker 12 to reciprocate within housing 13.

Housing 13 is cylindrical and is swaged or machined to a reduced diameter at its forward end. Striker 12 slides within housing 13 for delivering forward impacts to a movable bit shaft or chisel 14 and to an anvil 16 mounted at the forward end of housing 13. Anvil 16 is a preferably a steel tube that fits closely within around front end opening 17 of housing 13. A tubular front end portion 32 of anvil 16 protrudes from opening 17. A frustoconical rear end portion 31 thereof has an outer surface that engages a like-shaped inner surface of the swaged front end or nose 19 of housing 13 to retain anvil 16 in opening 17. Anvil 16 is interference fit into housing 13 but the taper thereof does not lock anvil 16 therein.

Chisel 14 slides within a central bore 15 of anvil 16, which bore 15 is coaxial with housing 13. A bit 18 is secured on a forward end portion 33 of chisel 14 that protrudes from tubular front end portion 32 of anvil 16. Bit 18 is secured by pins 20 inserted through outwardly opening, semi-circular grooves 21 in chisel 14 and corresponding transverse through-holes in bit 18. Pins 20 may be solid pins as shown or spiral-wound roll pins.

In this embodiment, chisel 14 has an outwardly opening annular groove 23 at an intermediate position between forward end portion 33 and an enlarged diameter rear portion 28. Annular groove 23 cooperates with a rear, enlarged diameter portion (counterbore) 25 of bore 15 to form a circumferential cavity 27 between chisel 14 and anvil 16 that confines a tubular spring 22, which may be either a coil spring or elastomeric sleeve. Spring 22 is confined under compression so that it biases chisel 14 to a rearwardmost position relative to anvil 16 as shown in FIG. 2. For this purpose, spring 22 engages a rearwardly facing annular step 29 at the front end of counterbore 25 and a rear wall 30 of annular groove 23. Wall 30 is also the front edge of enlarged diameter rear portion 28 of chisel 14.

A replaceable steel wear cover 24 is press-fit over nose 19 of housing 13. Cover 24 protects the forward end of housing 13 from excessive wear caused by rock and soil abrasion. Wear cover 24 is preferably a steel sleeve having a rearwardly flared (or forwardly tapering) inner profile whereby it fits closely onto the tapered portion of nose 19. The outer diameter of wear cover 24 is preferably less than or equal to the outer diameter of the tool housing 13.

As shown in FIG. 2, in order to prevent loosening of anvil 16, it is preferred that the rearwardmost position of movable chisel 14 be limited by the point at which a rear end surface of bit 18 contacts the front end of housing 13. In this position, a small gap remains between bit 18 and cover 24, and also between a radially inner portion of bit 18 and the front end of anvil 16. For this purpose, a rearward opening 34 of bit 18 includes an annular step 36 for engaging the front end of housing 13 as shown and an inner cylindrical recess 37 into which the front end of anvil 16 slidingly fits. A rearwardly extending tubular skirt 39 on the outer periphery of bit 18 at the rear end thereof covers the gap that opens and closes between bit 18 and both of anvil 16 and housing 13, hindering soil from entering. The gap that does exist between cover 24 and skirt 39 is shallow and never fully closes.

FIG. 2 illustrates the instant striker 12 impacts chisel 14. Prior to impact, chisel 14 has been reset to protrude a distance 26 from the rear end of anvil 16. Spring 22 compresses as striker 12 impacts chisel 14. The forward end of chisel 14 forms a pilot hole in the earth for bit 18, and bit 18 expands the pilot hole to the diameter of housing 13. Depending on ground conditions, bit 18 may be configured to expand pilot bore to the diameter of the housing, or wider, or smaller. Different heads with different major diameters may be used to optimize tool performance. If tool 10 is piercing a hard obstruction, chisel 14 will likely be forwardly displaced by a distance less than distance 26. Chisel 14 can then pierce obstructions more efficiently than a comparable tool lacking a movable chisel because chisel 14 and bit 18 transfer a greater force from striker 12 than would be the case if the momentum of the striker were transferred via anvil 16 to the tool housing 13 and the parts it carries, including the air distributing mechanism 11. This effect is optimized if the mass of the bit and chisel are selected to provide an optimum coefficient of restitution relative to the mass of striker 12, as suggested by Spektor U.S. Pat. No. 5,031,706.

If soil is being pierced and no hard obstruction is present, chisel 14 may be forwardly displaced by the distance equal to (or greater than) chisel stroke 26 as shown in FIG. 3. In this case, residual impact force from striker 12 is transferred to anvil 16, and therefore moves the housing 13 forward to close the gap between the back of the bit and front of the housing. The chisel is now reset to protrude a distance 26 from the rear end of the anvil 16, and the cycle can repeat.

A tool 10 having a movable chisel with the foregoing structure is simplified in structure and avoids the use of a threaded connection at the front of the tool where the stresses from impact are greatest. If replacement of the movable chisel is necessary, pins 20 are tapped out and bit or expander 18 is removed. Upon removal of the striker 12 and air distribution mechanism 11 from the rear end of the tool 10, chisel 14 and can be loosened from engagement with housing 13 and removed.

Figure 4:
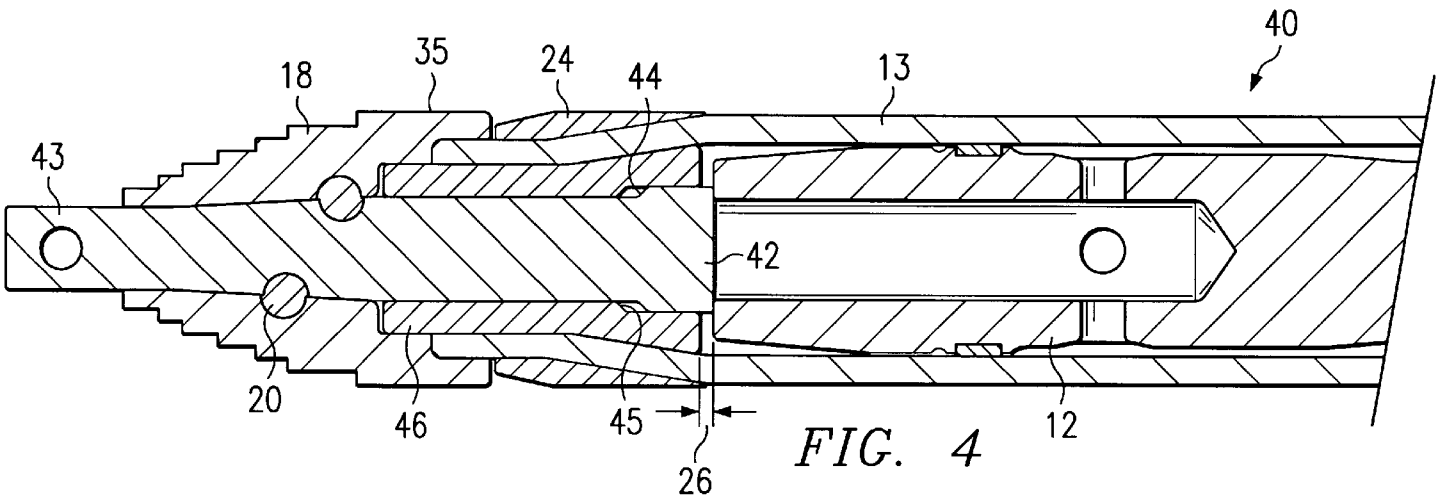
FIG. 4 is a forward section of a lengthwise sectional view of a second embodiment of a tool according to the invention showing the orientation of the striker at the instant it impacts the chisel.
Figure 5:
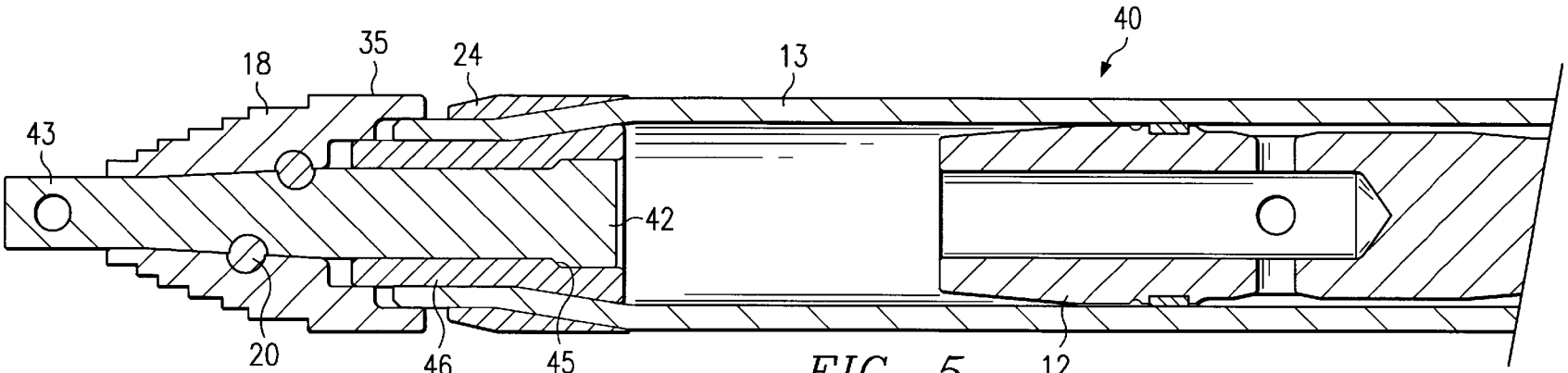
FIG. 5 is the same view as FIG. 4, showing the orientation of the striker and chisel when the tool is operating in reverse.

Referring now to FIGS. 4 and 5, a second embodiment of a tool 40 of the invention without spring 22 is illustrated. An enlarged diameter rear end portion 42 of a modified bit shaft or chisel 43 has a forwardly tapering step 44 that engages a rearwardly facing, forwardly tapering annular step 45 in the bore of a modified anvil 46. The striker impact urges chisel 43 forward until penetration resistance of the ground dissipates the impact force as described above, or end portion 42 engages step 44, assuming a countersunk position. Since the rear end of chisel 43 travels below the rear impact face of anvil 46, the total chisel stroke is greater than the distance 26, allowing the tool to make greater forward progress with each stroke.

Chisel 43 is returned to the initial position shown in FIG. 4 as housing 13 advances towards bit 18. If the bit is held in place by the soil, the striker can impact the front anvil and therefore drive the housing forward until it stops against the bit, thus resetting the chisel. If the bit is not secured by the soil, the striker impacts the chisel, and drives it forward through the already opened bore. Since the bore was already opened, very little energy is used in moving the bit and chisel. The striker will continue moving forward until it impacts the front anvil, driving the housing forward to catch up with the bit and chisel. In either case, the chisel is reset.

As the remaining part of the momentum of striker 12 is transferred to anvil 46, housing 13 and all the parts connected to it travel forward by a distance approximately equal to the stroke of chisel 43 between its extended and retracted positions. A spring for returning chisel 43 to its rearwardmost position is not needed. When the tool is in reverse mode and striker 12 is impacting against the tail nut instead of the anvil and chisel, the movable chisel assumes the forwardmost position shown in FIG. 5, but returns to its normal starting position after forward travel resumes.

Figure 6:
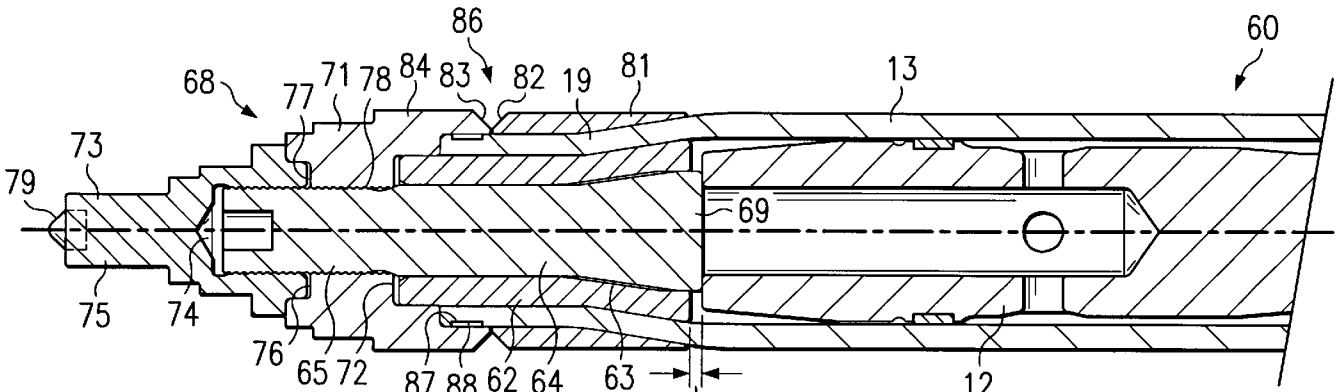
FIG. 6 is a forward section of a lengthwise sectional view of a third embodiment of a tool according to the invention showing the orientation of the striker at the instant it impacts the chisel.
Figure 7:
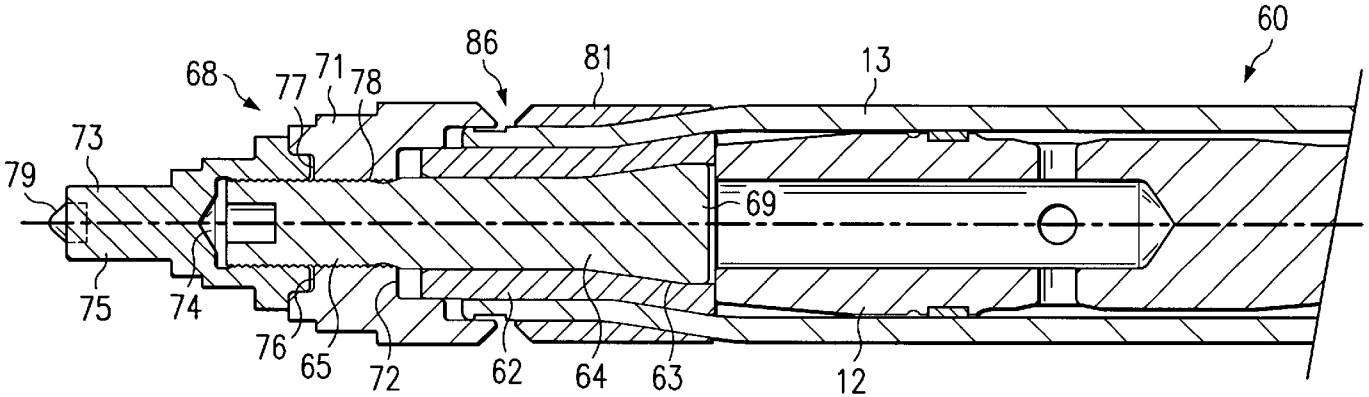
FIG. 7 is the same view as FIG. 6, showing the striker impacting the anvil.
Figure 8:
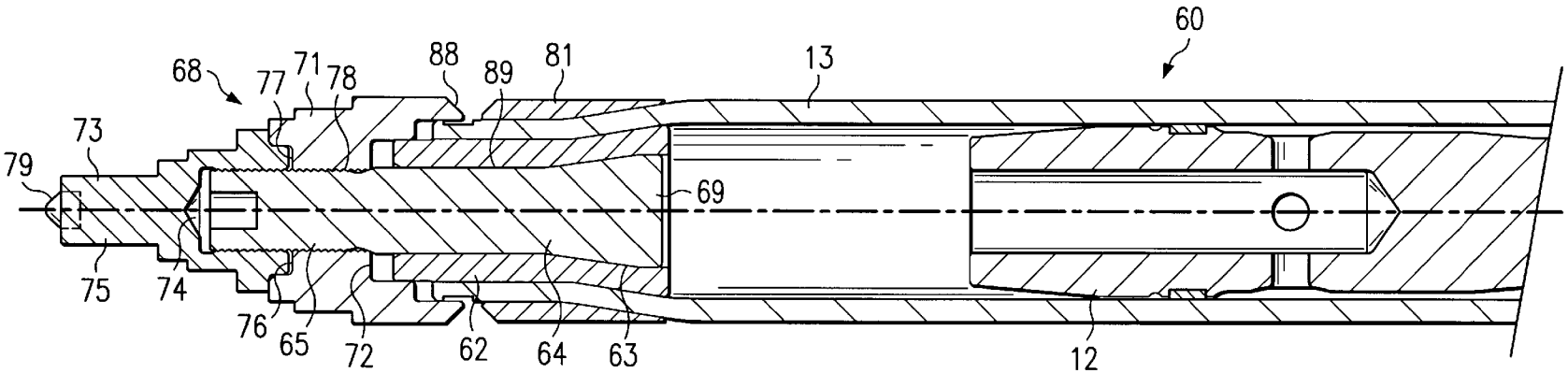
FIG. 8 is the same view as FIG. 6, showing the tool in reverse travel mode.

FIGS. 6, 7 and 8 illustrate a third embodiment of a tool 60 according to the invention. Like tool 40, tool 60 lacks a spring and operates in substantially the same manner as tool 40, but is improved in several important ways. Housing 13 receives a front anvil 62 that has a modified enlarged diameter rear end portion 63 that tapers forwardly over some of its length to its front end. The angle of this front anvil taper is shallow enough (6°, or about 5 to 7 degrees) to temporarily lock a modified bit shaft 64 in the forwardmost position while the tool is in reverse operation as shown in FIG. 8, thus reducing detrimental blows to bit shaft 64. For this purpose, a rear end potion 69 of bit shaft 64 has a matching external taper as shown. Bit shaft 64 unlocks from this position upon the first impact from striker 12 in the forward mode of operation In this embodiment, the bit 68 is a two piece assembly that is attached to the bit shaft or chisel 64 by means of threaded connections. A rear bit section 71 is threaded onto a threaded, protruding front end portion 65 of bit shaft 64 until it stops against a shoulder 72 behind threaded end portion 65 but still protruding from anvil 62. A front bit section 73 is then threaded onto bit shaft 64, and rear bit section 71 is tightened against the front bit section 73 in a jam nut fashion, by any suitable means, such as external hex flats provided on each. Rear bit section 71 moves forwardly a short distance as it is tightened against front section 73.

Front bit section 73 is preferably configured as a cap with a rearwardly opening, threaded blind hole 74 by which it is mounted on bit shaft 64, and a front end projection or "false chisel" 75 that resembles the protruding front end of the chisel 14, 43 of the preceding embodiments. A pointed carbide stud 79 may be centrally mounted in a forwardly facing position on projection 75 to enhance the tool's ability to break hard obstructions. A tubular rear flange 76 of front section 73 extends into a forwardly opening recess or counterbore 77 of a threaded through-hole 78 of rear bit section 71, leaving a slight clearance in the lengthwise direction as shown. This permits tightening in jam-nut fashion as desired but prevents soil from working inside the two-piece bit assembly. The clamp-loading of the bit sections 71, 73 provides for more secure mounting of the bit 68 onto bit shaft 64 and easier disassembly in comparison to pin mounting systems or threaded connections that do not apply an axial clamp load to threaded connection between bit and shaft, or in comparison to systems wherein a nut threadedly mounted in front of the bit holds the bit on.

A modified wear cover 81 has a forwardly tapered edge 82 that cooperates with a rearwardly tapered edge 83 of the skirt 84 of rear bit section 71 to form a V-shaped notch 86 that dislodges dirt more effectively than the arrangement of FIGS. 4 and 5. An annular groove 87 may be provided near the front end of housing 13 slightly ahead of notch 86 when edges 82, 83 are in contact (FIG. 6) for a seal bearing 88 that helps prevent penetration of grit into the space behind bit 68. Seal bearing 88 preferably lies flush with the outer periphery of nose 19 of housing 13 and thus does not expand and contract in an attempt to fill notch 86.

Operation of tool 60 is substantially the same as described above for tool 40. FIGS. 6 and 7 show the two stages of striker impact, first against bit shaft 64 and then against anvil 62. During reverse operation as shown in FIG. 8, striker 12 is accelerated rearwardly, impacting the rear anvil or tail nut in a manner known in the art, which subsequently drives the tool rearward. In this reverse mode, the bit 68 and bit shaft 64 are accelerated rearwardly when rear end potion 69 of bit shaft 64 bottoms against the taper of the bore 89 of anvil 62.

Tool 60 in accordance with the foregoing description thus provides further improvements in the structure of the anvil, bit and bit shaft. The bit is less prone to breakage and more readily disassembled than comparable known designs. The chisel or bit shaft is protected by a front end cap rather than directly exposed in the borehole. This facilitates repair in that the front end cap (bit section 73) can be removed and replaced without taking the rest of the tool or its front end apart, whereas bit shaft 64 cannot. Bit shaft 64 is also better protected from stress by the adoption of a semi-locking taper for use when the tool is operating in reverse.

Various modifications of the preceding embodiments are within the scope of the invention. For example, the bit may have a variety of shapes suitable for digging in various conditions, such as blades, projections or splines. The anvil may be shortened so that it does not protrude from the housing, eliminating the need for a rearwardly opening stepped bore in the bit. A rock-breaking tungsten carbide stud, rounded or pointed like stud 79, may be mounted on the front end of the movable chisel to enhance the tool's ability to break a rock or other obstruction. While for convenience of manufacture it is desirable to make the anvil, chisel, housing and wear cover radially symmetrical as described, some portions of the mechanism could be asymmetrical. For example, instead of enlarged diameter rear end portion 28, the chisel could have a radial projection that slides in a corresponding groove in the anvil bore. These and other equivalents are within the scope of the invention as expressed in the appended claims.

What is claimed is:

1. A ground piercing tool, comprising:

an elongated tubular tool housing;

a striker disposed for reciprocation within an internal chamber of the housing to impart impacts to a front impact surface for driving the tool forwardly through the ground;

an air distributing mechanism that reciprocates the striker in response to a supply of compressed fluid;

an anvil disposed in a front end opening of the tool housing, which anvil includes a rear, outer frustoconical portion which engages a like-shaped forwardly tapering inner wall of the housing whereby the anvil is held in the housing, the anvil having a lengthwise bore therein, and a rear end of the anvil defining the front impact surface for the striker; and a chisel slidably disposed in the bore of the anvil, which chisel is movable between a rearwardmost position at which a rear end portion of the chisel protrudes from the bore of the anvil to receive an initial impact from the striker, and a forwardmost position at which the striker can impact directly on a rear impact surface of the anvil.

2. The tool of claim 1, further comprising a bit mounted on a front end portion of the chisel that protrudes from the housing.

3. The tool of claim 2, wherein the bit has a maximum outer diameter approximately the same as or greater than or less than a maximum outer diameter of the housing.

4. The tool of claim 1, wherein the chisel has an enlarged diameter rear end portion that is in close sliding contact with an enlarged rear end portion of the anvil bore.

5. The tool of claim 4, wherein the enlarged diameter rear end portion of the chisel engages a step at the front end of the enlarged rear end portion of the anvil bore when the chisel is in its forwardmost position.

6. The tool of claim 5, wherein a rear end of the chisel is disposed forwardly of a rear impact face of the anvil when the chisel in its forwardmost position.

7. The tool of claim 5, wherein the chisel slides in the anvil bore free of biasing spring force.

8. The tool of claim 4, further comprising a spring confined under compression between a front end of the enlarged diameter rear end portion of the chisel and a step at the front end of the enlarged rear end portion of the anvil bore, which spring biases the chisel to the position at which a rear end portion of the chisel protrudes from the bore of the anvil to receive an initial impact from the striker.

9. The tool of claim 1, further comprising a spring confined under compression between the chisel and the anvil, which spring biases the chisel to its rearwardmost position.

10. The tool of claim 2, wherein the anvil protrudes from the front end opening of the housing and is slidingly received in a rearwardly opening cylindrical recess in the bit.

11. The tool of claim 3, wherein the bit is removably secured to the chisel by pins set in openings in the bit and chisel which prevent disengagement of the bit from the chisel.

12. The tool of claim 1, wherein the housing has a nose including a reduced diameter cylindrical front end portion and a forwardly tapering portion rearwardly thereof.

13. The tool of claim 12, further comprising a wear cover which fits over the nose of the housing.

14. The tool of claim 13, wherein the wear cover comprises a cylindrical sleeve having a forwardly tapering inner surface that engages the forwardly tapering portion of the nose of the housing.

15. A ground piercing tool, comprising:

an elongated tubular tool housing;

a striker disposed for reciprocation within an internal chamber of the housing to impart impacts to a front impact surface for driving the tool forwardly through the ground;

an air distributing mechanism that reciprocates the striker in response to a supply of compressed fluid;

an anvil disposed in a front end opening of the tool housing, the anvil having a lengthwise bore therein, and a rear end of the anvil defining the front impact surface for the striker;

a chisel slidably disposed in the bore of the anvil, which chisel is movable between a rearwardmost position at which a rear end portion of the chisel protrudes from the bore of the anvil to receive an initial impact from the striker, and a forwardmost position at which the striker can impact directly on a rear impact surface of the anvil, and wherein the chisel has an enlarged diameter rear end portion that is in close sliding contact with an enlarged rear end portion of the anvil bore such that the enlarged diameter rear end portion of the chisel engages a step at the front end of the enlarged rear end portion of the anvil bore when the chisel is in its forwardmost position; and a bit mounted on a front end portion of the chisel, which bit has an outer surface configured to engage the wall of a hole being bored so that as the striker first impacts the chisel and propels the chisel and bit forward, then impacts the impact surface of the anvil, and is then reset in preparation for another impact, the chisel and bit are propelled forward, increasing a gap between the bit and the front end of the housing, after which the housing is propelled forward, decreasing the gap between the bit and the front end of the housing and causing the chisel to assume its rearwardmost position.

16. The tool of claim 15, wherein a rear end of the chisel is disposed forwardly of a rear impact face of the anvil when the chisel in its forwardmost position.

17. The tool of claim 15, wherein the bit has a stepped, rearwardly opening recess therein, which recess is configured so that when the chisel is in its rearwardmost position, a step therein engages a front end of the housing, and a gap exists between the bit and a front end of the anvil.

18. The tool of claim 15, wherein the bit has a rearwardly extending tubular skirt that is in sliding contact with a nose of the housing and which covers the gap between the bit and the front end of the housing.

19. A ground piercing tool, comprising:

an elongated tubular tool housing;

a striker disposed for reciprocation within an internal chamber of the housing to impart impacts to a front impact surface for driving the tool forwardly through the ground;

an air distributing mechanism that reciprocates the striker in response to a supply of compressed fluid;

an anvil disposed in a front end opening of the tool housing, the anvil having a lengthwise bore therein, and a rear end of the anvil defining the front impact surface for the striker;

a bit shaft slidably disposed in the bore of the anvil, which bit shaft is movable between a rearwardmost position at which a rear end portion of the bit shaft protrudes from the bore of the anvil to receive an initial impact from the striker, and a forwardmost position at which the striker can impact directly on a rear impact surface of the anvil; and a bit mounted on a front end portion of the bit shaft, which bit has an outer surface configured to engage the wall of a hole being bored so that as the striker first impacts the bit shaft and propels the bit shaft and bit forward, then impacts the impact surface of the anvil, and is then reset in preparation for another impact, the bit shaft and bit are propelled forward, increasing a gap between the bit and the front end of the housing, after which the housing is propelled forward, decreasing the gap between the bit and the front end of the housing and causing the bit shaft to assume its rearwardmost position, wherein the bit comprises:

a rear bit section having a central threaded hole therethrough by which the rear bit section is secured to external threads on the front portion of the bit shaft; and a front bit section having a central threaded hole by which the front bit section is secured to external threads on the front portion of the bit shaft in front of the rear bit section, so that the front bit section is jammed against the rear bit section in a manner effective to apply an axial clamp load to both the front and rear bit section.

20. The tool of claim 19, wherein one of the front and rear bit sections has an inner projection that extends into a recess in the other bit section.

21. The tool of claim 20, wherein the inner projection comprises a tubular rear flange extending rearwardly from the front bit section, and the recess comprises a frontwardly opening counterbore of the central threaded hole through the rear bit section.

22. The tool of claim 21, wherein a clearance remains between a rear end of the tubular rear flange and a bottom wall of the counterbore when the front and rear bit sections are jammed together.

23. The tool of claim 21, wherein the front bit section is a cap and the central threaded hole therein is a blind hole that receives the front end portion of the bit shaft.

24. The tool of claim 19, wherein the front bit section is a cap and the central threaded hole therein is a blind hole that receives the front end portion of the bit shaft.

25. The tool of claim 19, wherein the rearwardmost position of the bit shaft occurs when the rear bit section contacts the front end of the housing, and can be changed by adjusting the position of the front and rear bit sections on the external threads of the front end portion of the bit shaft.

26. A ground piercing tool, comprising:

an elongated tubular tool housing;

a striker disposed for reciprocation within an internal chamber of the housing to impart impacts to a front impact surface for driving the tool forwardly through the ground;

an air distributing mechanism that reciprocates the striker in response to a supply of compressed fluid;

a reversing mechanism operable to cause the striker to deliver rearward impacts in order to drive the tool rearwardly through the ground;

an anvil disposed in a front end opening of the tool housing, the anvil having a lengthwise bore therein, and a rear end of the anvil defining the front impact surface for the striker;

a chisel slidably disposed in the bore of the anvil, which chisel is movable between a rearwardmost position at which a rear end portion of the chisel protrudes from the bore of the anvil to receive an initial impact from the striker, and a forwardmost position at which the striker can impact directly on a rear impact surface of the anvil, and wherein the chisel has an enlarged diameter rear end portion that is in close sliding contact with an enlarged rear end portion of the anvil bore such that the enlarged diameter rear end portion of the chisel engages a step at the front end of the enlarged rear end portion of the anvil bore when the chisel is in its forwardmost position, wherein the step and a contact surface of the enlarged diameter rear end portion of the chisel have a forwardly tapering, frustoconical shape with a sufficient taper to cause the chisel to become temporarily locked in its forwardmost position during rearward tool operation; and a bit mounted on a front end portion of the chisel, which bit has an outer surface configured to engage the wall of a hole being bored so that as the striker first impacts the chisel and propels the chisel and bit forward, then impacts the impact surface of the anvil, and is then reset in preparation for another impact, the chisel and bit are propelled forward, increasing a gap between the bit and the front end of the housing, after which the housing is propelled forward, decreasing the gap between the bit and the front end of the housing and causing the chisel to assume its rearwardmost position.

27. The tool of claim 26, wherein the taper of the step and the contact surface of the enlarged diameter rear end portion of the chisel is in the range of about 5 to 7 degrees.

* * * * *